US008251487B2

(12) United States Patent
Mitsunaga

(10) Patent No.: US 8,251,487 B2
(45) Date of Patent: Aug. 28, 2012

(54) IMAGE RECORDING APPARATUS

(75) Inventor: Osamu Mitsunaga, Tokyo (JP)
(73) Assignee: Riso Kagaku Corporation, Tokyo (JP)

( * ) Notice: Subject to any disclaimer, the term of this patent is extended or adjusted under 35 U.S.C. 154(b) by 395 days.
(21) Appl. No.: 12/610,495
(22) Filed: Nov. 2, 2009
(65) Prior Publication Data
US 2010/0118085 A1 May 13, 2010
(30) Foreign Application Priority Data
Nov. 7, 2008 (JP) ..... 2008-286407
(51) Int. Cl.
*B41J 2/165* (2006.01)
(52) U.S. Cl. ..... 347/32; 347/22; 347/29
(58) Field of Classification Search ..... None
See application file for complete search history.

(56) References Cited

U.S. PATENT DOCUMENTS
7,758,180 B2 * 7/2010 Kawabata ..... 347/104
2006/0066664 A1 * 3/2006 Kachi et al. ..... 347/33
FOREIGN PATENT DOCUMENTS
JP 09-123470 A 5/1997
* cited by examiner

*Primary Examiner* — Matthew Luu
*Assistant Examiner* — Erica Lin
(74) *Attorney, Agent, or Firm* — Holtz, Holtz, Goodman & Chick, PC

(57) ABSTRACT

An image recording apparatus includes an image recording unit having a recording head for jetting ink onto a recording medium and performing a recording process, a carrier mechanism for mounting and carrying the recording medium, a movement mechanism for moving the carrier mechanism and a recovery mechanism for applying a recovery process to the recording head. When the recovery process is performed, the recovery mechanism is moved to a first position opposing the recording head and otherwise the recovery mechanism is accommodated in the second position out of a carrier route of the carrier mechanism. Thus, an image recording apparatus capable of simultaneously performing all colors of recovery processes and also accommodating the recovery mechanism in saved space and its control method can be provided.

5 Claims, 9 Drawing Sheets

IMAGE RECORDING APPARATUS

CROSS REFERENCE TO RELATED APPLICATIONS

This Application is based upon and claims the benefit of priority from prior Japanese Patent Application No. 2008-286407, filed on Nov. 7, 2008, the entire contents of which are incorporated herein by reference.

BACKGROUND OF THE INVENTION

1. Field of the Invention

The present invention relates to an image recording apparatus for recording an image on a recording medium, such as paper, a film or the like, and its control method, and more particularly to an image recording apparatus for performing recovery process of an image recording unit including a nozzle and its control method.

2. Description of the Related Art

As an image recording apparatus, for example, an ink-jet full-line color printer is known. A recording head forming a plurality of nozzles for jetting ink in a direction (main scanning direction) orthogonal to a carrier direction (sub scanning direction) in which a recording medium is carried is provided with this printer. A plurality of these recording heads is arranged in the above-described sub scanning direction for each ink color at predetermined intervals.

In such a color printer (image recording apparatus), a recording head with a plurality of ink nozzles is opposed to a recording medium for recording images. Then, ink of a corresponding color is jetted from each ink nozzle of the recording head to the recording medium, and characters and an image are recorded on the recording medium.

However, when powdered paper and dust attach to the ink nozzle in the image recording apparatus having the above-described configuration, no ink is jetted from the ink nozzle. Sometimes the jetting direction deviates. When an image continues to be recorded on the recording medium in such a state, characters and images become blurred, and recording becomes incomplete. Therefore, such an image recording apparatus requires a recovery process for an ink nozzle.

As to a technology for performing the recovery process of an ink nozzle, for example, Patent document (Japanese Laid-open Patent Publication No. H9-123470) discloses the nozzle capping method of an ink-jet recording apparatus and an ink absorption method. According to this Patent document, an ink nozzle is recovered by moving an ink absorption unit to a position opposing a nozzle and driving a pump for absorbing ink.

SUMMARY OF THE INVENTION

It is an object of the present invention to provide an image recording apparatus capable of simultaneously recovering all colors without scaling it up and also reducing the space in a saving position, of a recovery mechanism and its control method.

In order to achieve the above-described purpose, an image recording apparatus in one aspect of the present invention includes an image recording unit with a recording head for jetting ink on a recording medium and recording images, a carrier mechanism for mounting and carrying the recording medium, a movement mechanism for moving the carrier mechanism, a recovery mechanism for recovering the recording head and a recovery mechanism control unit for moving the recovery mechanism to a first position opposing the recording head when performing the recovery process and otherwise accommodating it in a second position departing out of the carrier route of the carrier mechanism.

The control method of the image recording apparatus in another aspect of the present invention controls an image recording apparatus including an image recording unit with a recording head for jetting ink on a recording medium and recording images, a carrier mechanism for mounting and carrying the recording medium, a movement mechanism for moving the carrier mechanism and a recovery mechanism for recovering the recording head to move the recovery mechanism to a first position opposing the recording head when performing the recovery process and otherwise to accommodate it in a second position departing out of the carrier route of the carrier mechanism.

DESCRIPTION OF THE PREFERRED EMBODIMENTS

The preferred embodiments of the present invention will be explained in detail below with reference to the drawings.

In the following explanation, it is defined that the carrier direction of a recording medium is a sub scanning direction and a direction orthogonal to this carrier direction (sub scanning direction) is a main scanning direction.

Firstly, the first preferred embodiment of the present invention will be explained.

Figure 1:
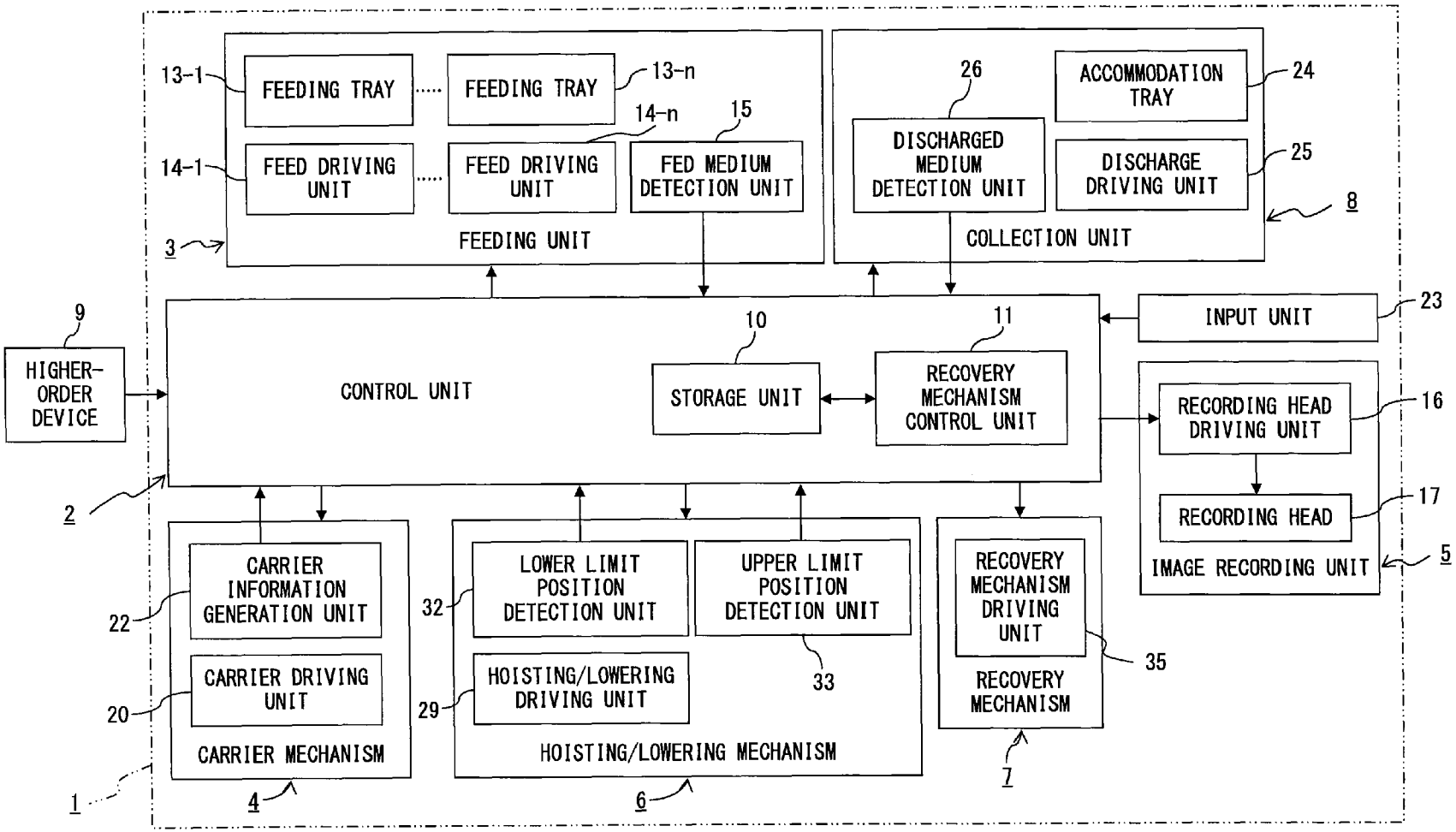
FIG. 1 illustrates the ideas of an image recording apparatus according to the first and second preferred embodiments of the present invention.
Figure 2:
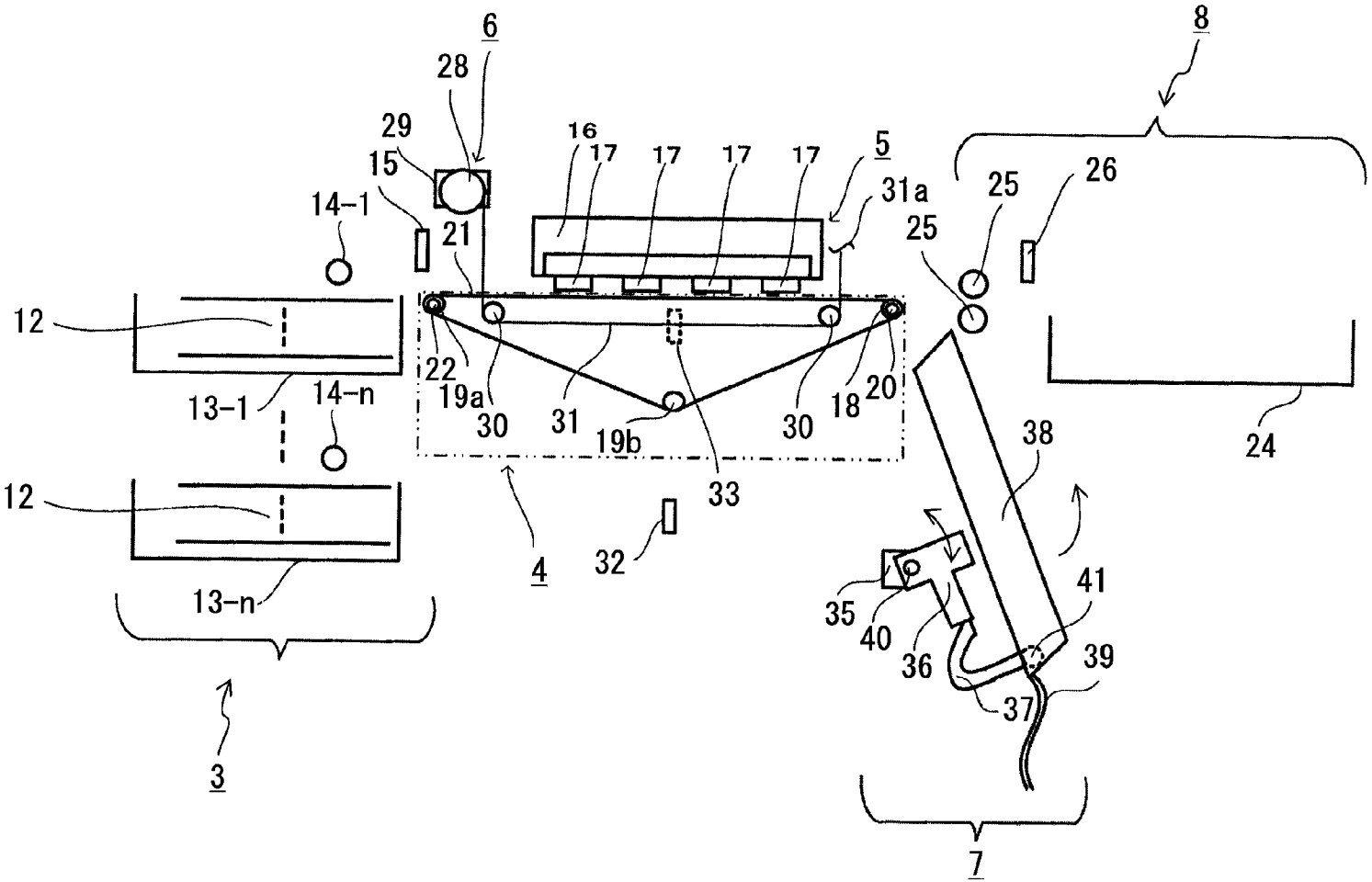
FIG. 2 illustrates an arrangement example of a feeding unit, a carrier mechanism, a hoisting/lowering mechanism, a recovery mechanism, an image recording unit and a collection unit in image recording apparatus according to the first and second preferred embodiment of the present invention.

FIG. 1 illustrates the idea of an image recording apparatus to this preferred embodiment. FIG. 2 illustrates arrangement examples of a feeding unit, a carrier mechanism, a hoisting/lowering mechanism, a recovery mechanism, an image recording unit and a collection unit in the image recording apparatus according to this preferred embodiment. Furthermore, FIGS. 3A through 3D illustrate an arrangement example of a carrier mechanism, a hoisting/lowering mechanism, a recovery mechanism, an image recording unit in the image recording apparatus according to this preferred embodiment.

Firstly, an image recording apparatus used in this preferred embodiment will be explained. The image recording apparatus 1 used in this preferred embodiment includes a control unit 2, a feeding unit 3, a carrier mechanism 4, an image recording apparatus 5, a hoisting/lowering mechanism 6, a recovery mechanism 7 and a collection unit 8.

The control unit 2 controls the entire image recording apparatus 1 and the feeding unit 3 carries a recording medium out of a feeding tray, which will be described later, and forwards it to the carrier mechanism 4. The carrier mechanism 4 carries the recording medium forwarded from the feeding unit 3 to the image recording unit 5 and the image recording unit 5 records an image on the recording medium. Then, the collection unit 8 discharges the recording medium on which an image is recorded and stores. The hoisting/lowering mechanism 6 moves the carrier mechanism 4 to an upper limit position (recording position) at the recording time of the image and moves the recovery mechanism 7 on the carrier mechanism 4 to a recovery process position.

Then, each component of the image recording apparatus 1 will be further explained. The control unit 2 has functions to control and calculate the image recording apparatus 1, and includes a process circuit composed of an MPU (micro processor unit), which is not illustrated in FIG. 2, non-volatile memory for storing a control program, the setting values for controlling the apparatus and the like, which is not illustrated in FIG. 2 and a storage unit 10, such as RAM (random-access memory), for temporarily storing image recording information.

The control unit 2 controls each component of the image recording apparatus 1 by reading the control program from the non-volatile memory and executing it. At this moment, the control unit 2 also functions as the recovery mechanism control unit 11. An instruction signal, which will be described later, and the like are also inputted to the control unit 2 from the input unit 23 of an operating panel or the like.

Although in the above-described configuration, the control unit 2 is made to function as the recovery mechanism control unit 11 by making the MPU execute the control program, the recovery mechanism control unit 11 can also be configured as a signal processing circuit (hardware) controlled by the MPU and be provided for the control unit 2.

The feeding unit 3 includes a plurality of feeding trays 13-1 through **13-*n*, a plurality of feed driving units 14-1 through 14-*n* provided for the feeding tray 13-1 through 13-*n* and a fed medium detection unit 15** for detecting a fed recording medium.

The feeding trays 13-1 through **13-*n* are composed of, for example, feeding cassettes and accommodate sheet-like recording media of different sizes. The feed driving units 14-1 through 14-*n* is provided with, for example, a feeding roller. The feeding roller strikes against a recording medium at a top surface, accommodated in corresponding feeding trays 13-1 through 13-*n*, carries the recording medium out of the feeding trays 13-1 through 13-*n* and forwards it to the carrier mechanism 4. The fed medium detection unit 15** is composed of, for example, an optical transparent or reflective sensor, an electrostatic-capacity sensor or the like and detects, for example, the front end of the recording medium in the sub scanning direction.

The carrier surface of the carrier mechanism 4 is provided opposing the ink jetting exit of a plurality of recording heads 17, as illustrated in FIG. 2. In the frame of the carrier mechanism 4 a driving roller 18 and a driven rollers **19*a* and 19*b*, which are arranged apart in the sub scanning direction, and a carrier driving unit 20 for rotating the driving roller 18 are arranged. An endless carrier belt 21 is mounted on these rollers 18, 19*a* and 19*b* in such a way as to rotate. In the frame of the carrier mechanism 4, a carrier information generation unit 22 and an absorption fan, which is not illustrated in FIG. 2**, are also provided.

The carrier information generation unit 22 is provided on the same shaft as the driven roller **19*a* on the upstream side in the carrier direction of the recording head 17. The carrier information generation unit 22 includes, for example, an encoder and generates an encoder pulse signal using the movement state of the detected carrier belt 21 as the carrier information of carrier timing and the like. The absorption fan, which is not illustrated in FIG. 2, generates negative pressure and absorbs the recording medium 12 on the carrier belt 21**.

The image recording unit 5 includes the recording head 17 and a recording head driving unit 16. A plurality of nozzles for jetting ink is linearly arranged in a length exceeding the maximum recording medium width based on its design on the recording head 17 and a corresponding nozzle is controlled to individually jet ink by a driving signal. The recording head driving unit 16 outputs a driving signal for driving each nozzle of a corresponding recording head 17 on the basis of recording data supplied from the control unit 2.

The collection unit 8 includes an accommodation tray 24, a discharge driving unit 25 and a discharged medium detection unit 26. The accommodation tray 24 is composed of a collection tray for accommodating discharged recording media 12. The discharge driving unit 25 is composed of, for example, a roller and discharges recording media 12 on which an image is recorded to the accommodation tray 24. The discharged medium detection unit 26 is composed of, for example, an optical transparent or reflective sensor, an electrostatic-capacity sensor or the like and detects the back end of the recording medium 12 in the sub scanning direction of the recording medium 12. If necessary, the discharged medium detection unit 26 can also detect the front end of the recording medium 12.

The hoisting/lowering mechanism 6 is used to vertically move the above-described carrier mechanism 4 (or both the carrier mechanism 4 and the recovery mechanism 7). The hoisting/lowering mechanism 6 includes a winding-up roller 28, a hoisting/lowering driving unit 29, a hoisting/lowering driven roller 30, a cable wire (hereinafter called "wire") 31, a lower limit position detection unit 32 and an upper limit position detection unit 33, as illustrated in FIG. 2.

The winding-up roller 28 winds up the wire 31 and hoists/lowers the carrier mechanism 4 (or both the carrier mechanism 4 and the recovery mechanism 7) on the wire 31. The hoisting/lowering driving unit 29 drives the winding-up roller 28. The hoisting/lowering driven roller 30 is arranged in the four corners of the carrier mechanism 4 and enables the carrier mechanism 4 to hoist/lower in parallel.

One end of the wire 31 is attached to the above-described winding-up roller 28 and the other end **31*a* is attached to the frame, which is not illustrated in FIG. 2. Each of the lower limit position detection unit 32 and the upper limit position detection unit 33 is composed of, for example, an optical transparent/reflective sensor or the like. The lower limit position detection unit 32 detects that the carrier mechanism 4 reaches a preset lower limit position. The upper limit position detection unit 33 detects that the carrier mechanism 4 reaches a preset upper limit position. The detection information of both the lower limit position detection unit 32 and upper limit position detection unit 33 is reported to the above-described control unit 2**.

The recovery mechanism 7 includes a recovery mechanism driving unit 35, a recovery mechanism guide 36, a recovery mechanism arm 37, an ink tray 38 and a liquid waste tube 39. The recovery mechanism driving unit 35 and the recovery mechanism guide 36 are connected by a recovery mechanism driving shaft 40 and the recovery mechanism guide 36 is rotated in the arrow direction by the recovery mechanism driving unit 35. The recovery mechanism arm 37 and the ink tray 38 are connected by an ink bearing 41 and rotate in the same direction in accordance with the rotation of the above-described recovery mechanism guide 36. The recovery mechanism arm 37 can be expanded and contracted to the recovery mechanism guide 36. The detailed movement process of the recovery process will be described later.

The ink tray 38 is formed, for example by resin and can collect ink inside. The ink tray 38 is provided with a wiping member, which is not illustrated in FIG. 2, and ink attached to the recording head 17 can be wiped off by driving the wiping member in the main scanning direction.

The liquid waste tube 39 discharges the ink accommodated in the ink tray 38 to a liquid waste tank, which is not illustrated in FIG. 2.

A higher-order device 9, such as a personal computer (PC) or the like, as illustrated in FIG. 1, is connected to the image recording apparatus 1 of this preferred embodiment via, for example, LAN (local area network) or the like. The higher-order apparatus 9 corresponds to a computer operated by a user which makes the image recording apparatus 1 according to this preferred embodiment and notifies the image recording apparatus 1 according to this preferred embodiment of job information as the information of a recording process.

The job information includes recording data used when applying a recording process to the recording medium 12, the size information of the recording medium 12, the specification information of a margin value in the carrier direction used when applying a recording process to the recording medium 12, the specification information of the number of pieces of the recording media to which a recording process is applied and the like. When receiving the job information reported from the higher-order device 9, the control unit 2 stores the job information in the above-described storage unit 10 as image recording information.

The processing operation in the above-described configuration, of this preferred embodiment will be explained below. It is assumed that the carrier mechanism 4 is initially located in the position illustrated in FIG. 3A.

When the job information is reported from the higher-order apparatus 9, the control unit 2 instructs the hoisting/lowering driving unit 29 of the hoisting/lowering mechanism 6 to hoist the carrier mechanism 4. The hoisting/lowering driving unit 29 is driven according to this instruction and the wire 31 is wound up by the winding-up roller 28. The carrier mechanism 4 held by the wire 31 is hoisted by the winding-up operation of the wire 31 and reaches the upper limit position (recording position).

When the carrier mechanism 4 reaches the upper limit position, the above-described upper limit position detection unit 33 notifies the control unit 2 of the detection of the carrier mechanism 4. The control unit 2 stops the drive of the hoisting/lowering driving unit 29 by this notice. FIG. 2 illustrates the state where the carrier mechanism 4 reaches the upper limit position (recording position) and recording is possible.

Then, the control unit 2 controls the carrier driving unit 20 of the carrier mechanism 4 to drive the driving roller 18. Then, the carrier belt 21 starts to rotate. Furthermore, the control unit 2 controls the feeding unit 3 to carry the recording medium 12 at the top out of the feeding tray (for example, feeding tray 13-1) and forward it to the carrier mechanism 4.

Then, the fed medium detection unit 15 on the downstream side of the feeding unit 3 detects the front end of the recording medium 12. Then, it outputs an edge signal to the control unit 2. The control unit 2 performs a control process using this edge signal as a trigger signal for generating recording process timing. Then, the carrier belt 21 of the carrier mechanism 4 carries the recording medium 12 while absorbing it.

However, although an encoder pulse signal generated by the carrier information generation unit 22 is carrier information, it is also used as a synchronous signal in the case where the recording head 17 records an image. The control unit 2 stores timing for starting jetting ink from a nozzle in non-volatile memory in advance as the number of pulses.

The control unit 2 makes the nozzle of the recording head 17 jet ink on the recording medium 12 with timing this number of pulses coincides with the encoder pulse.

The control unit 2 outputs recording data for each line used when applying a recording process to the recording head driving unit 16 on the basis of the image recording information stored in the storage unit 10. The recording head driving unit 16 controls the recording head 17 to applying a recording process to the recording medium 12 on the basis of the recording data.

The recording medium 12 to which a recording process is applied thus is forwarded to the collection unit 8 provided on the downstream side of the carrier mechanism 4 while being pinched and held by the above-described discharge driving unit 25 and being carried on the downstream side. Then, the discharged medium detection unit 26 detects the back end of the recording medium 12 and notifies the control unit 2 of it. Furthermore, the recording medium 12 is accommodated in the accommodation tray 24.

Next, the recovery process of the recording head 17 in the image recording apparatus 1 will be explained in detail together with the operation of the recovery mechanism 7.

When the input unit 23 instructs a recovery process, the control unit 2 instructs the hoisting/lowering driving unit 29 of the hoisting/lowering mechanism 6 to lower the carrier mechanism 4. When the hoisting/lowering driving unit 29 is driven by this instruction, the winding-up roller 28 rotates and pulls out the wire 31. As a result, the carrier mechanism 4 gradually lowers. When the carrier mechanism 4 reaches the lower limit position, the lower limit position detection unit 32 notifies the control unit 2 of the detection of the carrier mechanism 4. The control unit 2 stops the drive of the hoisting/lowering driving unit 29 by this notice and makes the carrier mechanism 4 stop in the position illustrated in FIG. 3A.

Figure 3A:
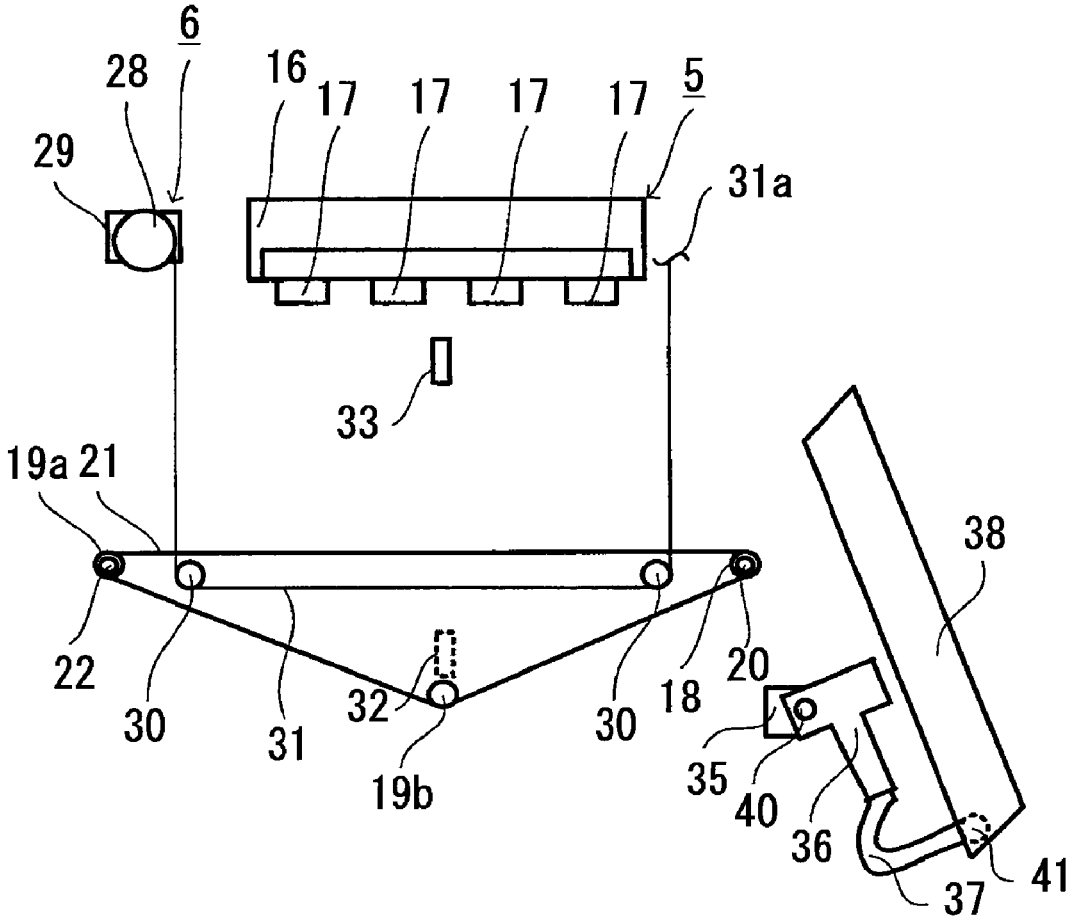
FIG. 3A illustrates a state where the carrier mechanism is in its lower limit position and the recovery mechanism is saved.
Figure 3B:
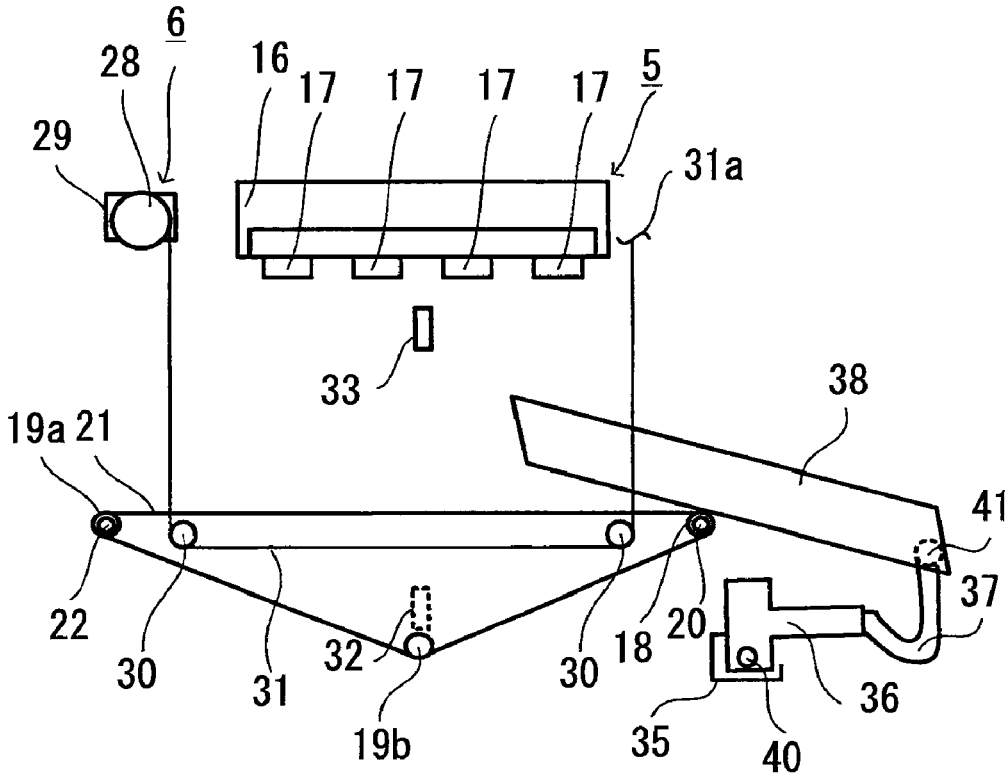
FIG. 3B illustrates a state where the carrier mechanism is in its lower limit position and the recovery mechanism is on the way of being mounted on the carrier mechanism.

Then, the control unit 2 instructs the recovery mechanism control unit 11 to move the recovery mechanism 7 on the carrier mechanism 4. The recovery mechanism control unit 11 drives the recovery mechanism driving unit 35 of the recovery mechanism 7 according to the instruction to rotate both the recovery mechanism guide 36 and the recovery mechanism arm 37 around the above-described recover mechanism driving shaft 40. By this process, the ink tray 38 is obliquely hanged over the carrier mechanism 4, as illustrated in FIG. 3B.

Figure 3C:
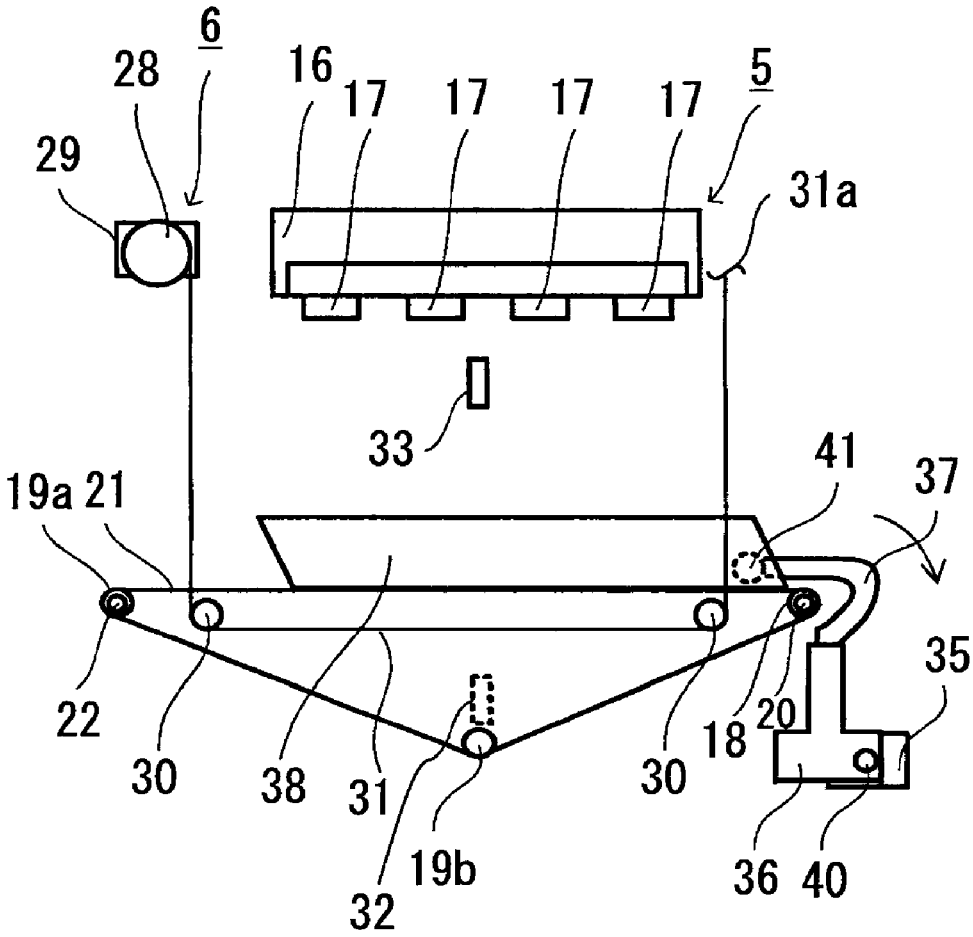
FIG. 3C illustrates a state where the carrier mechanism is in its lower limit position and the recovery mechanism is mounted on the carrier mechanism.

Furthermore, when the recovery mechanism control unit 11 drives the recovery mechanism driving unit 35 of the recovery mechanism 7, the ink tray 38 is mounted on the carrier mechanism 4, as illustrated in FIG. 3C.

Then, the control unit 2 instructs the hoisting/lowering driving unit 29 of the hoisting/lowering mechanism 6 to hoist the carrier mechanism 4. When the hoisting/lowering driving unit 29 is driven by this instruction, as described above, the winding-up roller 28 winds up the wire 31.

Figure 3D:
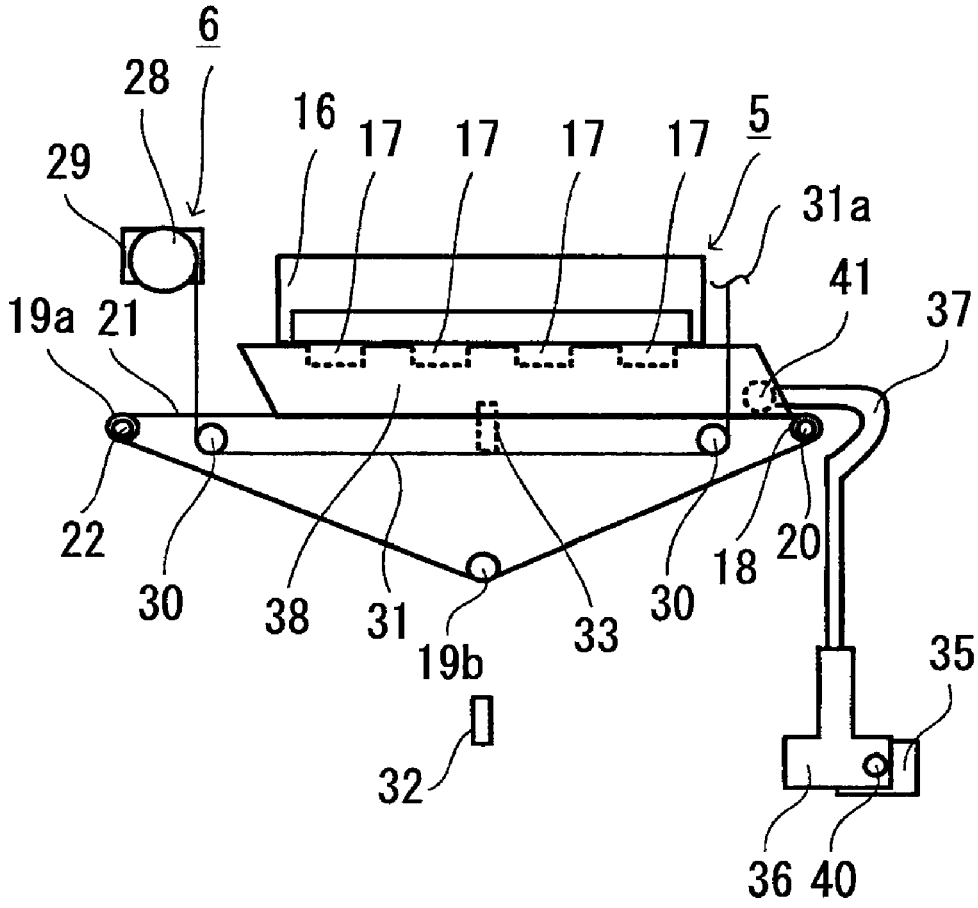
FIG. 3D illustrates a state where the recovery mechanism is positioned so as to recover the recording head.

Both the carrier mechanism 4 and the recovery mechanism 7 on the carrier mechanism 4 are hoisted by the winding-up of the wire 31. When the ink tray 38 of the recovery mechanism 7 strikes against the image recording unit 5, as illustrated in FIG. 3D, the control unit 2 stops the drive of the hoisting/lowering driving unit 29. At this moment, the recovery mechanism 7 is in the recovery operation position and is hanged over the recording head 17. The recovery mechanism arm 37 of the recovery mechanism 7 is gradually extended out of the recovery mechanism guide 36 while the ink tray 38 is being hoisted. In the state illustrated in FIG. 3D, the recovery mechanism arm 37 is fully extended and at this moment all colors of the recording heads 17 are covered with the ink tray 38.

Then, the control unit 2 instructs the recording head driving unit 16 to jet ink and the recording head driving unit 16 jets ink from the recording heads 17. Although the jetted ink is stored in the ink tray 38, part of the jetted ink is attached on the surface of the recording head 17. Therefore, the control unit 2 wipes out the ink on the surface of the recording head 17 by moving the wiping member provided for the ink tray 38, which is not illustrated in FIG. 2, in the main scanning direction. The ink wiped out thus is stored in the ink tray 38.

Then, the control unit 2 instructs the hoisting/lowering driving unit 29 of the hoisting/lowering mechanism 6 to lower the carrier mechanism 4. When the hoisting/lowering driving unit 29 is driven by this instruction, the winding-up roller 28 rotates and the wire 31 is pulled out. Then, both the carrier mechanism 4 and the recovery mechanism 7 on the carrier mechanism 4 are lowered by pulling out the wire 31. When the carrier mechanism 4 lowers up to the lower limit position, the lower limit position detection unit 32 notifies the control unit 2 of the detection of the carrier mechanism 4. The control unit 2 stops the hoisting/lowering driving unit 29 by this notice. At this moment, the recovery mechanism arm 37 of the recovery mechanism 7 is accommodated in the recovery mechanism guide 36.

Then, the control unit 2 instructs the recovery mechanism control unit 11 to move the recovery mechanism 7 from on the carrier mechanism 4 to the saving position. When the recovery mechanism control unit 11 drives the recovery mechanism driving unit 35 of the recovery mechanism 7, both the recovery mechanism guide 36 and the recovery mechanism arm 37 rotate in the arrow direction of FIG. 3C. Thus, the ink tray 38 moves in the saving position direction and enters the state illustrated in FIG. 3B conversely as described above. When the recovery mechanism control unit 11 further drives the recovery mechanism driving unit 35, as illustrated in FIG. 3A, the recovery mechanism 7 moves to the saving position. At this moment, ink stored in the ink tray 38 flows into the liquid waste tank, which is not illustrated in FIG. 2, via the liquid waste tube 39.

As described above, according to this preferred embodiment, when a recovery process is performed, the recovery mechanism 7 is moved to a position opposing the recording head 17. When no recovery process is performed, the accommodation space of the recovery mechanism 7 can be reduced by obliquely saving the recovery mechanism 7. Furthermore, since a recovery process can be applied to all colors of recording heads 17, time required for a recovery process can be shortened.

Next, the second preferred embodiment of the present invention will be explained.

The recovery process has, for example, a mode for regular performance (hereinafter called "normal recovery process") and a mode executed when jetting failure cannot be recovered by the normal recovery process (hereinafter called "strong recovery process"). In the normal recovery process, a small amount of ink is jetted from the recording head 17, while in the strong recovery process, a large amount of ink is jetted. Which should be used, the normal or strong recovery process is determined on the basis of the number of processed records, a record processing time and also the selection of a user.

Figure 4A:
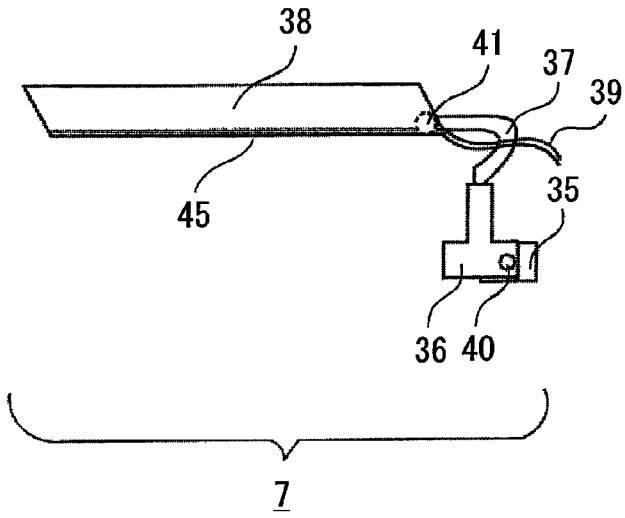
FIGS. 4A-B illustrate the state of the recovery mechanism after recovering an ink nozzle jetted with a small amount of ink.
Figure 4B:
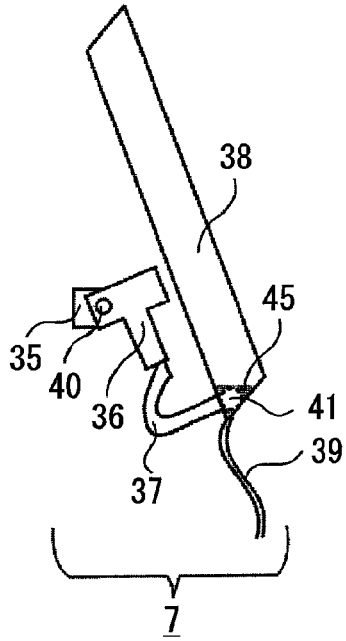

FIG. 4 explains a process for discharging ink 45 stored in the ink tray 38 to a liquid waste tank. In the normal recovery process, since a small amount of ink 45 is stored in the ink tray 38, as illustrated in FIG. 4A, the ink 45 is never overflowed from the ink tank 38 even when the ink tray 38 is moved to the saving position, as illustrated in 4B.

However, in the strong recovery process, since a large amount of ink 45 is jetted from the recording head 17, there is a possibility that the ink 45 may be overflowed from the ink tray 38 when the ink tray 38 is moved to the saving position in one go.

Therefore, in the second preferred embodiment, it is structured to prevent ink 45 accommodated in the ink tray 38 from overflowing even when the above-described strong recovery process is performed. It will be explained in detail below.

Figure 5C:
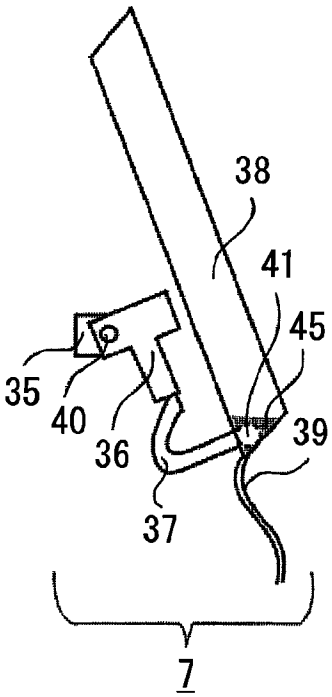
FIGS. 5A-C illustrate the state of the recovery mechanism after recovering an ink nozzle jetted with a large amount of ink.
Figure 5B:
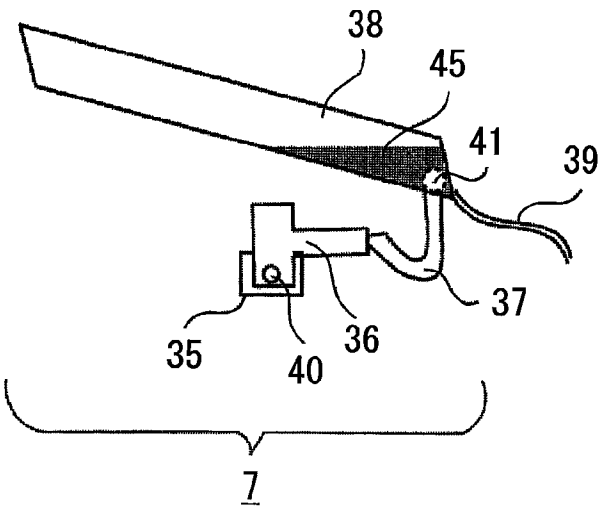
Figure 5A:
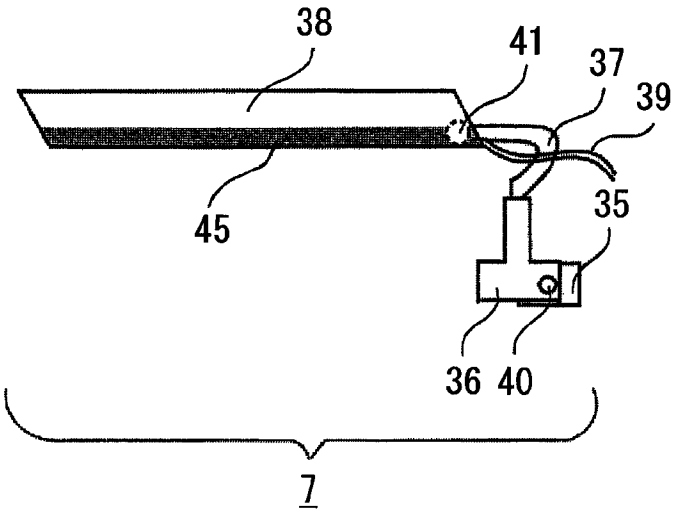
Figure 6:
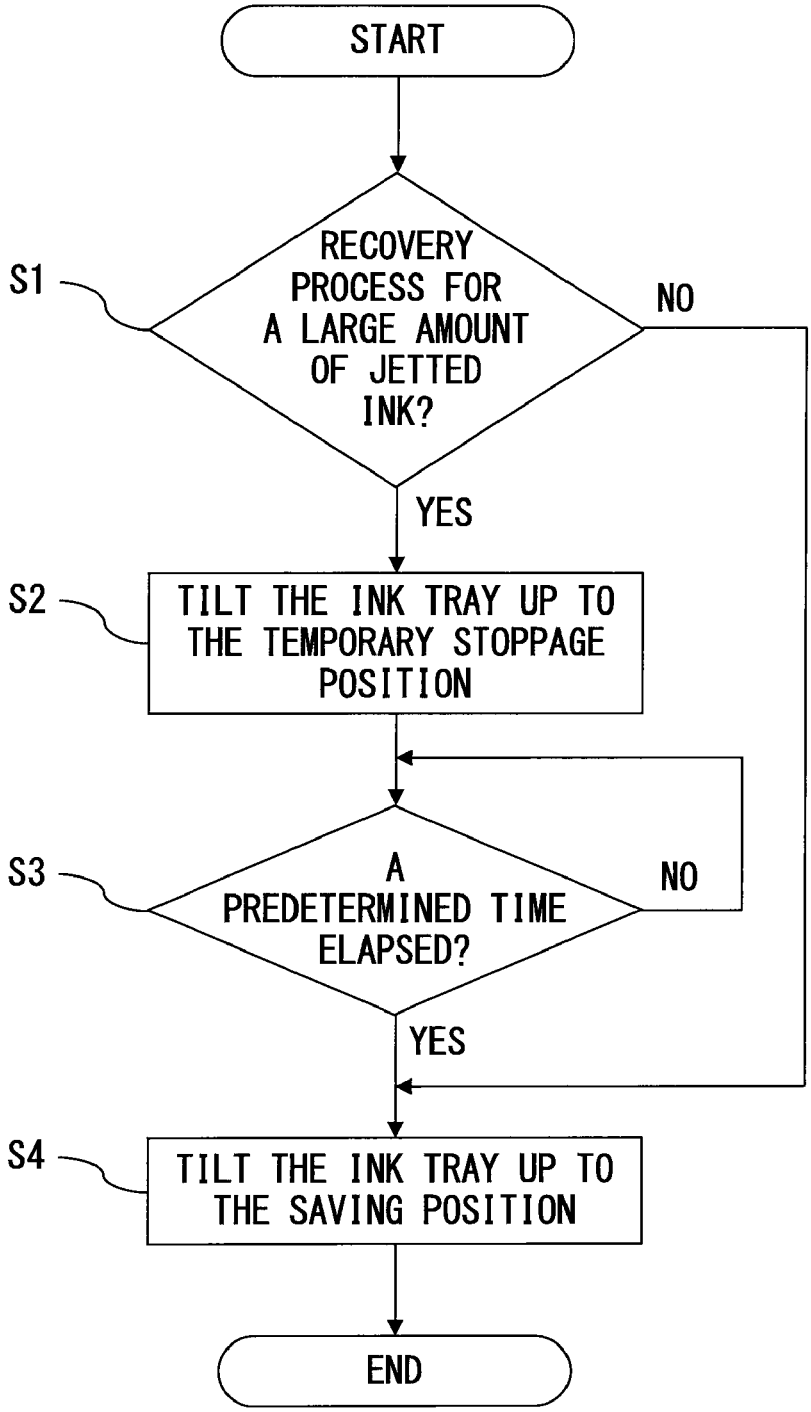
FIG. 6 is a flowchart illustrating the process of the second preferred embodiment of the present invention.

FIG. 5 explains the process of the second preferred embodiment and FIG. 6 is a flowchart explaining the process in the second preferred embodiment.

This process is realized by an MPU reading and executing a control program stored in advance on non-volatile memory, which is not illustrated in FIG. 2, provided for the above-described control unit 2. The control unit 2 functions as the recovery mechanism control unit 11 by the MPU executing this control program.

For example, when receiving a recovery process request from the input unit 23, performing a series of recovery processes and moving the recovery mechanism to the saving position, the control unit 2 also starts a process according to the flowchart illustrated in FIG. 6. FIG. 5A is the state where the recovery mechanism 7 exits in the position illustrated in FIG. 3C.

Firstly, the control unit 2 determines whether a large amount of ink is jetted in the performed recovery process (strong recovery process) (step (hereinafter called "S") 1. If it is determined that a large amount of ink is jetted (YES in S1), that is, it is the strong recovery process, the control unit 2 tilts the ink tray 38 up to the temporary stoppage position (S2). It drives the recovery mechanism driving unit 35 for a predetermined time to tilt the ink tray 38 little, for example, up to the state illustrated in FIG. 5B.

Then, the control unit 2 determines whether the predetermined time has elapsed (S3). This is set a time ink 45 stored in the ink tray 38 is sufficiently discharged via the liquid waste tube 39. Then, after the predetermined time elapses (YES in S3), the control unit 2 tilts the ink tray 38 up to the saving position illustrated in FIG. 5C (S4). By processing thus, when the recovery mechanism 7 is driven, the ink 45 can be prevented from overflowing from the ink tray 38.

In the case of the normal recovery process, the above-described determination (S1) is NO, the control unit 2 tilts the ink tray 38 up to the saving position without temporarily stopping the drive of the recovery mechanism 7 (S4). Even by such a process, since in the normal recovery process, only a small amount of ink 45 is accommodated in the ink tray 38, the ink 45 never overflows.

Although in the above explanation, only one temporary stoppage position is provided for the ink tray 38, a plurality of such temporary stoppage positions can also be provided according to the amount of jetted ink 45 in the recovery process. Alternatively, the ink tray 38 can be driven at low speed without being temporarily stopped.

As described above, according to this preferred embodiment, by controlling the tilt of the ink tray 38 according to the amount of jetted ink 45 in the recovery process, the ink 45 stored in the ink tray 38 can be prevented from overflowing into its inside and each unit in the image recording apparatus can be prevented from being soiled.

Furthermore, the recovery process can be simultaneously applied to plural colors of ink nozzles arranged in the image recording apparatus to shorten its recovery processing time and reduce the space in the saving position of the recovery mechanism. Furthermore, an image recording apparatus capable of surely collecting ink without ink collected from the nozzle soiling its interior and its control method can be provided.

Furthermore, various preferred embodiments of the present invention can be configured by properly combining the plurality of components disclosed in each of the preferred embodiments. For example, some components can also be deleted from the entire configurations of each of the preferred embodiments. Alternatively, components across the different preferred embodiments can be properly combined.

Furthermore, the present invention is not limited to the above-described preferred embodiments and actually their components can be modified and embodied without departing from its spirit.

What is claimed is:

1. An image recording apparatus comprising:

an image recording unit that includes a recording head for jetting ink onto a recording medium and performing a recording process;

a carrier mechanism for mounting and carrying the recording medium;

a movement mechanism for moving the carrier mechanism;

a recovery mechanism for applying a recovery process to the recording head; and a recovery mechanism control unit for moving the recovery mechanism to a first position opposing the recording head when performing the recovery process and for accommodating the recovery mechanism to a second position out of a carrier route of the carrier mechanism;

wherein the recovery mechanism comprises an ink tray member for receiving ink jetted from the recording head, and when the recovery mechanism is accommodated in the second position the recovery mechanism control unit tilts the ink tray member lower than the first position; and wherein the recovery mechanism control unit gradually tilts the ink tray member according to an amount of jetted ink in the recovery process to move the recovery mechanism to the second position.

2. An image recording apparatus comprising:

an image recording unit that includes a recording head for jetting ink onto a recording medium and performing a recording process;

a carrier mechanism for mounting and carrying the recording medium;

a movement mechanism for moving the carrier mechanism;

a recovery mechanism for applying a recovery process to the recording head; and a recovery mechanism control unit for moving the recovery mechanism to a first position opposing the recording head when Performing the recovery process and for accommodating the recovery mechanism to a second position out of a carrier route of the carrier mechanism;

wherein the recovery mechanism comprises an ink tray member for receiving ink jetted from the recording head, and when the recovery mechanism is accommodated in the second position the recovery mechanism control unit tilts the ink tray member lower than the first position; and wherein the recovery mechanism control unit modifies a speed of tilting the ink tray member according to an amount of jetted ink in the recovery process to move the recovery mechanism to the second position.

3. The image recording apparatus according to claim 1, wherein a third position of the recovery mechanism exists between the first and second positions, and the recovery mechanism comprises an arm member which extends while the recovery mechanism is moving from the third position to the first position and contracts while the recovery mechanism is moving from the first position to the third position.

4. The image recording apparatus according to claim 3, wherein a third position of the recovery mechanism exists between the first and second positions, and the recovery mechanism comprises an arm member which extends while the recovery mechanism is moving from the third position to the first position and contracts while the recovery mechanism is moving from the first position to the third position.

5. An image recording apparatus comprising:

an image recording unit that includes a recording head for jetting ink onto a recording medium and performing a recording process;

a carrier mechanism for mounting and carrying the recording medium;

a movement mechanism for moving the carrier mechanism;

a recovery mechanism for applying a recovery process to the recording head, the recovery mechanism being movable between a first position opposing the recording head and a second position that is outside of a carrier route of the carrier mechanism; and a recovery mechanism control unit for controlling the recovery mechanism to move to the first position when performing the recovery process and to move to the second position to be accommodated outside of the carrier route of the carrier mechanism when not performing the recovery process;

wherein the recovery mechanism comprises an ink tray member for receiving ink jetted from the recording head;

wherein the ink tray is tilted more when the recovery mechanism is in the second position than when the recovery mechanism is in the first position.

* * * * *